US011006727B2

(12) United States Patent
Crapet

(10) Patent No.: US 11,006,727 B2
(45) Date of Patent: May 18, 2021

(54) ASSEMBLY DEVICE BETWEEN AN APPLICATOR ASSEMBLY AND A HEAD OF A BOTTLE

(71) Applicant: ALBEA SERVICES, Gennevilliers (FR)

(72) Inventor: Yann Crapet, Fremecourt (FR)

(73) Assignee: ALBEA SERVICES, Gennevilliers (FR)

( * ) Notice: Subject to any disclaimer, the term of this patent is extended or adjusted under 35 U.S.C. 154(b) by 8 days.

(21) Appl. No.: 16/397,981

(22) Filed: Apr. 29, 2019

(65) Prior Publication Data

US 2019/0328108 A1 Oct. 31, 2019

(30) Foreign Application Priority Data

Apr. 27, 2018 (FR) ..... 1853702

(51) Int. Cl.

| | |
|---|---|
| ***A46B 11/00*** | (2006.01) |
| ***A45D 34/04*** | (2006.01) |
| ***A45D 40/26*** | (2006.01) |
| ***B65D 51/32*** | (2006.01) |

(52) U.S. Cl.

CPC ..... *A45D 34/046* (2013.01); *A45D 34/043* (2013.01); *A45D 34/045* (2013.01); *A45D 40/264* (2013.01); *A45D 40/265* (2013.01); *A45D 40/267* (2013.01); *B65D 51/32* (2013.01); *A46B 2200/1053* (2013.01)

(58) Field of Classification Search

CPC .. A45D 34/043; A45D 34/045; A45D 34/046; A45D 40/264; A45D 40/265; A45D 40/267; A46B 2200/1053

USPC ..... 401/126, 127

See application file for complete search history.

(56) References Cited

U.S. PATENT DOCUMENTS

| | | | | |
|---|---|---|---|---|
| 7,503,718 | B2 * | 3/2009 | Hamada | A45D 34/046 401/122 |
| 9,375,072 | B2 * | 6/2016 | Drugeon | A45D 40/0068 |
| 9,957,088 | B2 * | 5/2018 | Jacob | A45D 34/046 |
| 2008/0273914 | A1 | 11/2008 | Hamada | |
| 2017/0245618 | A1 | 8/2017 | Chen et al. | |
| 2018/0098614 | A1 | 4/2018 | Crapet et al. | |

* cited by examiner

*Primary Examiner* — Jennifer C Chiang

(74) *Attorney, Agent, or Firm* — Steven M. Greenberg, Esq.; Shutts & Bowen LLP

(57) ABSTRACT

In an assembly device between an applicator assembly and a head of a bottle, the applicator assembly includes at least two sub-assemblies of parts, a first sub-assembly referred to as an outer sub-assembly, and a second sub-assembly referred to as an inner sub-assembly. The inner sub-assembly is mobile in translation in the outer sub-assembly, along a main direction combined with the main longitudinal extension direction of the outer sub-assembly, along a course limited by a blocking member. The blocking member is in an embedded connection with the outer sub-assembly.

9 Claims, 5 Drawing Sheets

22''
22'
29
25
15
28
31
12

22
10
24
B-B

22'
27

A-A

X

X
A
B
B
A 24
22
10
B-B

22''
29
24
25

27
22

24
22
10
A-A

X

X
A
B
B
A

X
22''
27
21'
B-B

P
27
21'

21
27

22
24
12
A-A

X

X
A
B
B
A

X
22"
22
20
24
21'
12
10
B-B 21
27

A-A

X

X
A
B
B
A

ASSEMBLY DEVICE BETWEEN AN APPLICATOR ASSEMBLY AND A HEAD OF A BOTTLE

CROSS REFERENCE TO RELATED APPLICATIONS

This application claims priority under 35 U.S.C. § 119(a) to French Patent Application Ser. No. 1853702, filed Apr. 27, 2018, the entire teachings of which are incorporated herein by reference.

BACKGROUND OF THE INVENTION

Field of the Invention

The present invention relates to the field of cosmetic packaging and more particularly to the field of receptacles intended for shipping cosmetic product and that include a reservoir and an applicator assembly.

Description of the Related Art

It is known, in the field of cosmetic packaging, to provide receptacles intended for shipping cosmetic product, the receptacles including a reservoir, on the one hand, and an applicator assembly, on the other hand. Often, the applicator assembly and the reservoir form a portable, self-sufficient receptacle. The reservoirs, moreover, bear the bottle name for people skilled in the art. In this respect, people skilled in the art most of the time design bottles with threaded necks (or heads), in particular for intuitive assembly/disassembly of the applicator assembly with respect to the bottle.

Some people skilled in the art have attempted to replace this intuitive screwing movement with a push/pull movement. The idea was to render unique the gesture for using a casing implementing such a movement.

One of the aims of the invention is to propose an alternative assembly solution between an applicator assembly and a head of a bottle, so as to obtain an alternative gesture, in particular with a limited number of mechanical parts making it possible for this gesture.

Thus, the invention relates to an assembly device between an applicator assembly and a head of a bottle, the applicator assembly including at least two sub-assemblies of parts, a first sub-assembly referred to as an outer sub-assembly and a second sub-assembly referred to as an inner sub-assembly, the inner sub-assembly being mobile in translation in the outer sub-assembly, along a main direction coincident with the main longitudinal extension direction of the outer sub-assembly, along a course limited by blocking means, the blocking means being in embedded connection with the outer sub-assembly.

BRIEF SUMMARY OF THE INVENTION

According to the invention, the assembly device is capable of occupying three positions:

- a closing/locking position of the applicator assembly on the head of the bottle,
- an in-use position of the applicator assembly wherein the applicator assembly is not in contact with the head of the bottle,
- an intermediate position wherein the inner sub-assembly is free to slide inside the outer sub-assembly, in particular between two means of blocking the outer sub-assembly.

According to the invention, also, the moving from the closing/locking position to the intermediate position, then from the intermediate position to the in-use position is carried out by actuating the outer sub-assembly, along the main direction, along a single direction, referred to as the pulling direction.

The device of the invention implements a limited number of assemblies of parts, in particular an inner sub-assembly intended to slide inside an outer sub-assembly. In addition, the movement leading to the disassembly of the applicator sub-assembly with respect to the head of the bottle is a pulling movement, along a single direction, in a single way, in other words without back-and-forth along the direction. Thus, the device of the invention proposes a single gesture, in particular with a limited number of mechanical parts that, taken as a whole, make this gesture possible. According to different embodiments of the invention, which can be taken together or separately:

- the assembly device of the invention is devoid of any elastic means for returning to any position of the assembly device,
- the moving from one to the other of the positions of the assembly device according to the invention is not accompanied in any case by actuation of a the elastic means,
- the outer sub-assembly is one single part,
- the outer sub-assembly is a plurality of parts mounted fixed with respect to one another,
- the head of the bottle is devoid of threading,
- the maintaining in the closing/locking position of the applicator assembly on the head of the bottle is carried out via cooperation of shapes between a portion of the inner sub-assembly having at least one claw and a portion of the head of the bottle having at least one groove,
- the outer sub-assembly is a substantially hollow part having a material thickness with an inner wall and an outer wall defined on either side of the material thickness,
- the maintaining in the closing/locking position of the applicator assembly on the head of the bottle is provided by a part, referred to as locking part, which has a finger of material intended to block the claw in the groove by wedging of the finger between the claw and the inner wall of the outer sub-assembly,
- the outer sub-assembly and the locking part form one single mechanical part,
- the outer sub-assembly and the locking part are made from the same material,
- in the in-use position, the relative movement of the inner sub-assembly in the outer sub-assembly is blocked by interference of a retaining means of the inner sub-assembly by an abutment of the outer sub-assembly,
- the retaining means of the inner sub-assembly is a bead of material protruding from the inner sub-assembly,
- the abutment protrudes from the inner wall of the outer sub-assembly,
- the bead and abutment are excrescences of material intended to maintain the assembly device in the in-use position by a frictional force,
- the frictional force is initiated in at least one of the points of contact between the bead and the abutment,
- the assembly device of the invention further includes a wiper intended to be mounted in the head of the bottle and an applicator for a cosmetic product intended to be mounted at the end of a rod belonging to the inner sub-assembly, the rod is designed such that, when the assembly device is in the closing/locking position, the applicator is plunged inside a bottle from which comes the head of the bottle, the seal of the assembly device with regards to the outside when the assembly device is in the closing/locking position is provided by crushing of a portion of the wiper between the head of the bottle and a hollow portion of the inner sub-assembly, in particular with a bottom of the hollow portion of the inner sub-assembly.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
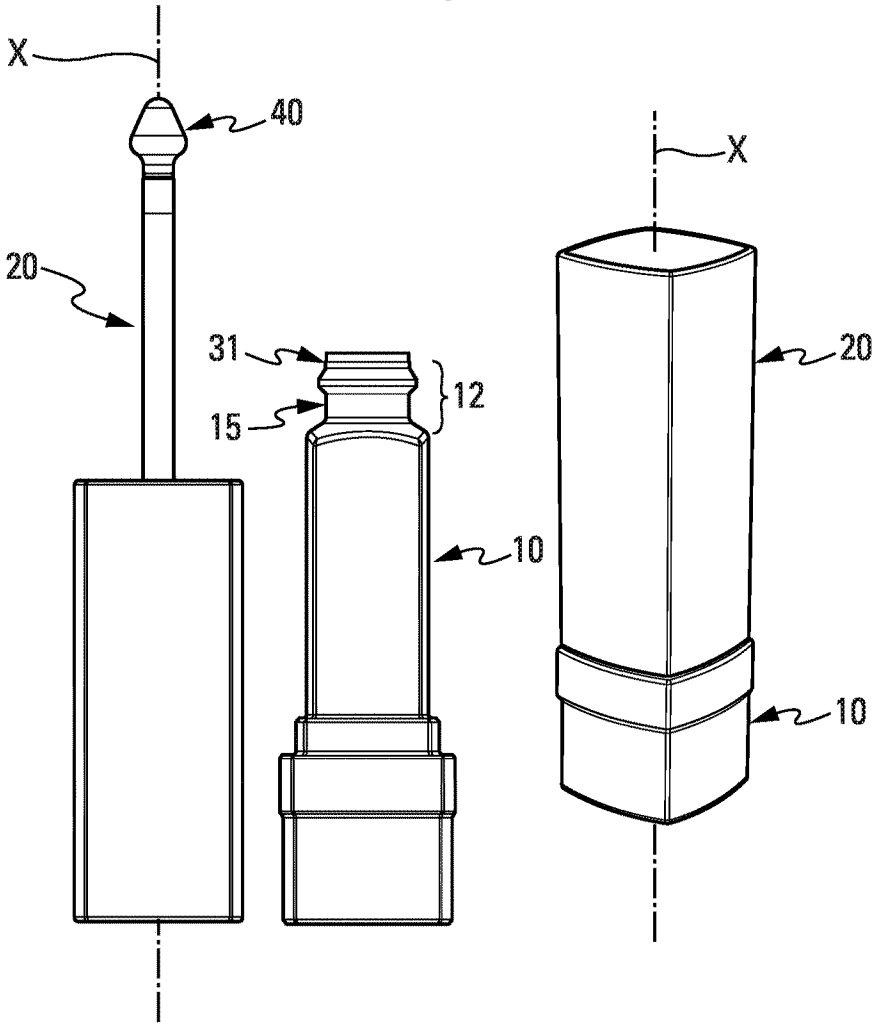
FIG. 1 is illustration of an embodiment of an applicator sub-assembly according to the invention, an illustration of an embodiment of a head of a bottle according to the invention (and of an associated bottle) and an illustration of an applicator assembly and of the bottle when the assembly device of the invention is in the closing/locking position.

As stated hereinabove, FIG. 1 shows an example of a bottle 10 and of a head of a bottle 12. FIG. 1 also shows an example of an applicator assembly 20, the applicator assembly 20 carrying an applicator tip 40 intended for the application of a cosmetic product on the skin/the eyelashes/the nails of a user. This cosmetic product can have a viscous form such as a mascara, be in liquid state (gloss) or in a semi-liquid state (polish for the lips or for the nails of a user). The applicator tip 40 will be adapted to the use in question and to the cosmetic product shipped in the bottle 10. This applicator tip 40 can be a brush, a tip usually used for the lips of a user or also a brush.

FIG. 1 also shows the applicator assembly 20 and the bottle 10 when the assembly device of the invention is in the closing/locking position.

Figure 2:
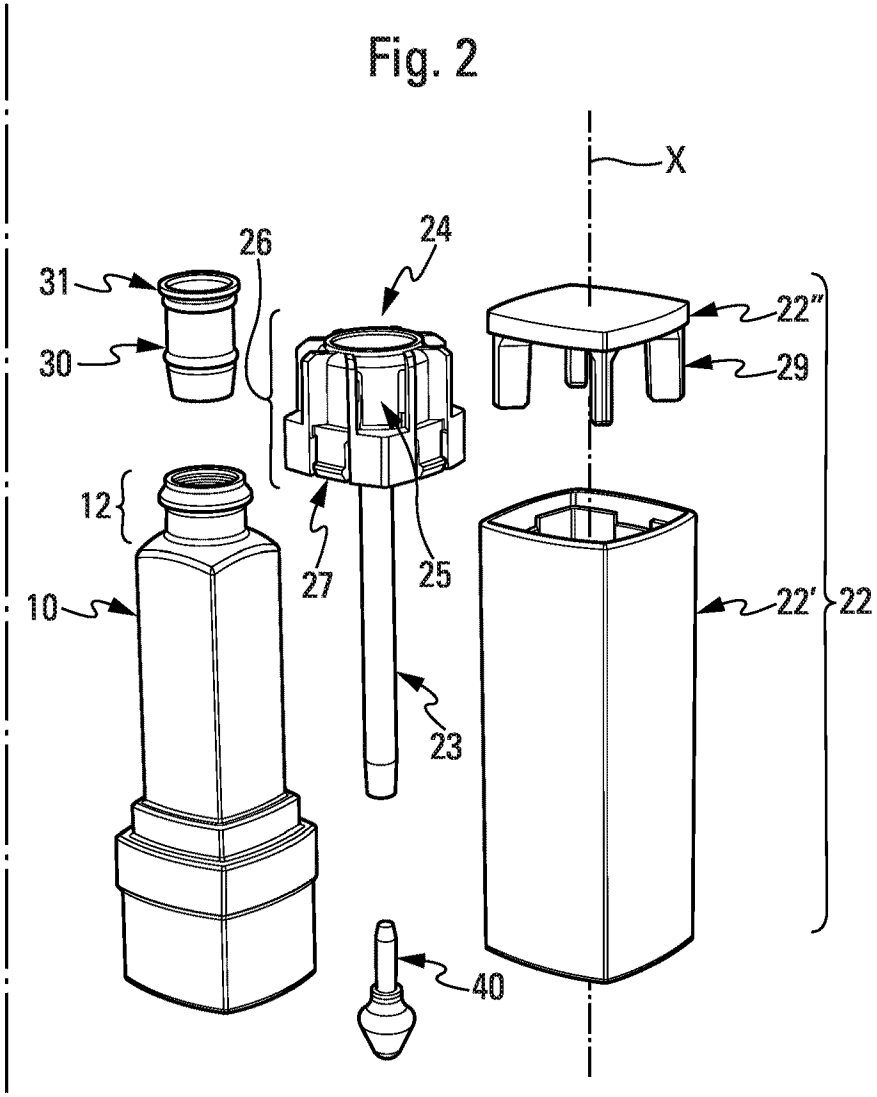
FIG. 2 is an exploded view of the constituent parts of the assembly device according to one same embodiment example of the invention as that shown in FIG. 1, FIGS. 3*a* to 3*f* show the assembly device in a closing/locking position according to the same embodiment example of the invention as that shown in FIGS. 1 to 2, FIG. 3*a* being a top view, FIG. 3*b* a front view, FIG. 3*c* a cross-sectional view according to the axis A-A marked in FIG. 3*a*, FIG. 3*d* a detailed view of FIG. 3*c*, FIG. 3*e* a cross-sectional view according to the axis B-B marked in FIG. 3*a* and FIG. 3*f* a detailed view of FIG. 3*e*, FIGS. 4*a*-4*f* show the assembly device in an intermediate position according to the same embodiment example of the invention as that shown in the preceding figures with the same distribution of the views as for FIGS. 3*a*-3*f*, FIGS. 5*a*-5*f* show the assembly device between the intermediate position and the in-use position according to the same embodiment example of the invention as that shown in the preceding figures and with the same distribution of the views as for FIGS. 3*a*-3*f*, FIGS. 6*a*-6*e* show the assembly device in the in-use position according to the same embodiment example of the invention as that shown in the preceding figures and with the same distribution of the views as for FIGS. 3*a*-3*e*.

More specifically, the invention relates to an assembly device between an applicator assembly 20 and a head of a bottle 12, the applicator assembly 20 including at least two sub-assemblies of parts, a first sub-assembly referred to as an outer sub-assembly 22 and a second sub-assembly referred to as an inner sub-assembly 24 (see FIG. 2).

According to the invention, the inner sub-assembly 24 is mobile in translation in the outer sub-assembly 22, in other words inside the outer sub-assembly 22, along a main direction combined with the main longitudinal extension direction of the outer sub-assembly 22, in particular along a course limited by blocking means, the blocking means being in embedded connection with the outer sub-assembly 22.

This direction is marked X and shown in most of the figures.

The term "the inner sub-assembly 24 is mobile in translation in the outer sub-assembly 22" means that the inner sub-assembly 24 and the outer sub-assembly 22 are in sliding connection, even as a sliding pivot connection if the respective shape so makes it possible. Indeed, in the embodiment example shown here, the outer sub-assembly 22 has a cylindrical shape with a substantially rectangular base and the inner sub-assembly 24 has a functional portion that is rather parallelepipedal, which prohibits any movement in rotation of one with respect to the other, in particular along a main direction X. This would not be the case if the outer sub-assembly 22 was cylindrical with a circular base with an inner sub-assembly 24 having a functional portion that has a cylindrical shape of revolution. Thus, a sliding pivot connection between the outer 22 and inner 24 sub-assemblies would be referred to.

In this respect, the assembly device according to the invention is not limited to the type of parts shown in the figures; it also covers the case where the sub-assemblies 22, 24 implemented are cylindrical in revolution (although this embodiment is not explicitly shown here).

By "the inner sub-assembly 24 has a functional portion", this means a functional portion that includes structural elements, of the claw 25 or retaining means/bead of material 27 type, the structural elements 25, 27 having dedicated technical functions. The functional portion is marked 26 in FIG. 2.

More generally, the assembly device of the invention contributes to a group of parts and further includes a wiper 30 intended to be mounted in the head of the bottle 12.

On the other hand, the applicator tip 40, also called cosmetic product applicator, is intended to be mounted at the end of a rod 23 belonging to the inner sub-assembly 24. This rod 23 is designed such that, when the assembly device is in the closing/locking position, the applicator is plunged inside a bottle 10 (see FIG. 2).

It is also useful to note, that by "the inner sub-assembly 24 has a functional portion", this also means a functional portion 26 that has a technical shape that provides for the seal of the assembly device with regards to the outside in particular when the assembly device is in the closing/locking position.

When the assembly device is in the closing/locking position the seal is provided by crushing of a portion of the wiper 30 between the head of the bottle 12 and a hollow portion of the inner sub-assembly, called the bottom 28 of the inner sub-assembly 24. The crushed portion of the wiper 30 is that which protrudes from the head of the bottle 12 when the wiper is mounted therein; it is marked 31 in FIGS. 1, 2 and 3*f*. The bottom 28 of the inner sub-assembly 24 is advantageously flat so as to provide an optimum crushing, as it is uniform, of the portion 31 of the wiper 30 between it and the head of the bottle 12 (also, see FIG. 3*f*).

Figures 3A, 3B, 3C, 3D, 3E, 3F:
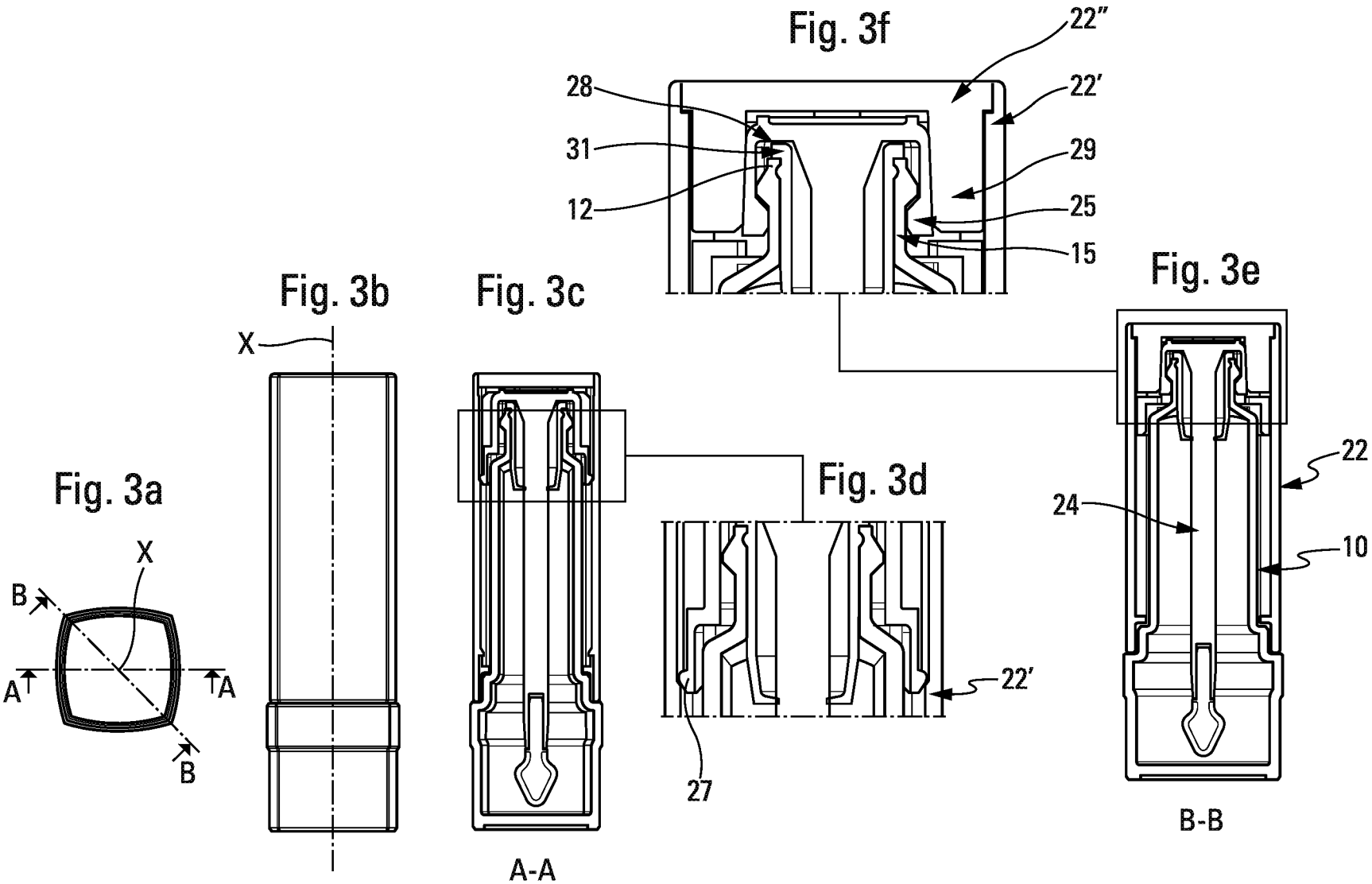

It is also useful to note, that the maintaining in the closing/locking position of the applicator assembly 20 on the head of the bottle 12 is provided by a cooperation of shapes between a portion of the inner sub-assembly 24 having at least one claw 25 and a portion of the head of the bottle 12 having at least one groove 15 (see FIGS. 1, 3*e* and 3*f*).

Indeed, the outer sub-assembly 22 is a mainly hollow part. This means that the outer sub-assembly 22 has a body 22', the body 22' having a material thickness with an inner wall and an outer wall defined on either side of the material thickness.

The locking of the applicator assembly 20 on the head of the bottle 12 is ensured by a part, referred to as a locking part, and marked 22" in FIGS. 1, 3*e* and 3*f*. This part has, indeed, a finger of material 29 intended to block the claw 25 in the groove 15 by wedging of the finger 29 between the claw 25 and the inner wall of the body 22' of the outer sub-assembly 22 (also, see FIGS. 3*e* and 3*f*); this is then referred to as locking of the applicator assembly 20 on the head of the bottle 12.

Advantageously and in a non-limiting manner, the outer sub-assembly 22 and the locking part 22" form a single mechanical part, preferably made from the same material.

However, in the embodiment example shown here, the outer sub-assembly 22 and the locking part 22" are separate parts, this without leaving the scope of the invention.

It is to be noted, that in the case of a plurality of parts including the outer sub-assembly 22, more preferably, the latter are mounted fixed with respect to one another.

By "the maintaining in closing/locking position of the applicator assembly 20 on the head of the bottle 12 is provided by a cooperation of shapes between a portion of the inner sub-assembly 24 having at least one claw 25 and a portion of the head of the bottle 12 having at least one groove 15", this means that this closing/locking position is also noteworthy, in that it is obtained on a head 12 of a bottle 10 and for a bottle 10 with the original shape, in particular a bottle 10 usually used for applicator receptacles of lipstick. More specifically, a the bottle is usually intended for applicators of cosmetic product that have the form of a stick of lipstick, within receptacles including at least one mechanical device for raising/lowering the stick of lipstick. In other words, the assembly device according to the invention enables the use of shapes of receptacles that are unusual in the field of applicator assemblies intended for the application of a cosmetic product on the skin/the eyelashes/the nails of a user, even on the lips of a user (when the cosmetic product has the form of a polish).

This technical form is characterised by a head of a bottle 12 including a groove 15, hollow, and a bottle that is rather parallelepipedal (without the latter characteristic being limiting), the at least one claw 25 being directly engaged, without an intermediate part, with the head 12 of the bottle 10.

It is useful to note, moreover, that the inner 24 and outer 22 sub-assemblies are blocked in the closing/locking position, thanks to a cooperation of shapes between the retaining means/bead of material 27 of the inner sub-assembly 24 and a slight projection of material provided on the inner wall of the outer sub-assembly 22, in particular on the inner wall of the body 22' of the outer sub-assembly 22 (see FIGS. 3*c* and 3*d*).

According to the invention, the assembly device is capable of occupying three positions:

- a closing/locking position of the applicator assembly 20 on the head of the bottle 12 of which details have just been provided using FIGS. 1, 2 and 3*a*-3*f*.
- an in-use position of the applicator assembly, wherein the applicator assembly is not in contact with the head of the bottle (see, in particular, FIGS. 6*a*-6*e*).
- an intermediate position, wherein the inner sub-assembly is free to slide inside the outer sub-assembly, in particular between two blocking means of the outer sub-assembly (see, in particular, FIGS. 4*a*-4*f*).

Figures 4A, 4B, 4C, 4D, 4E, 4F:
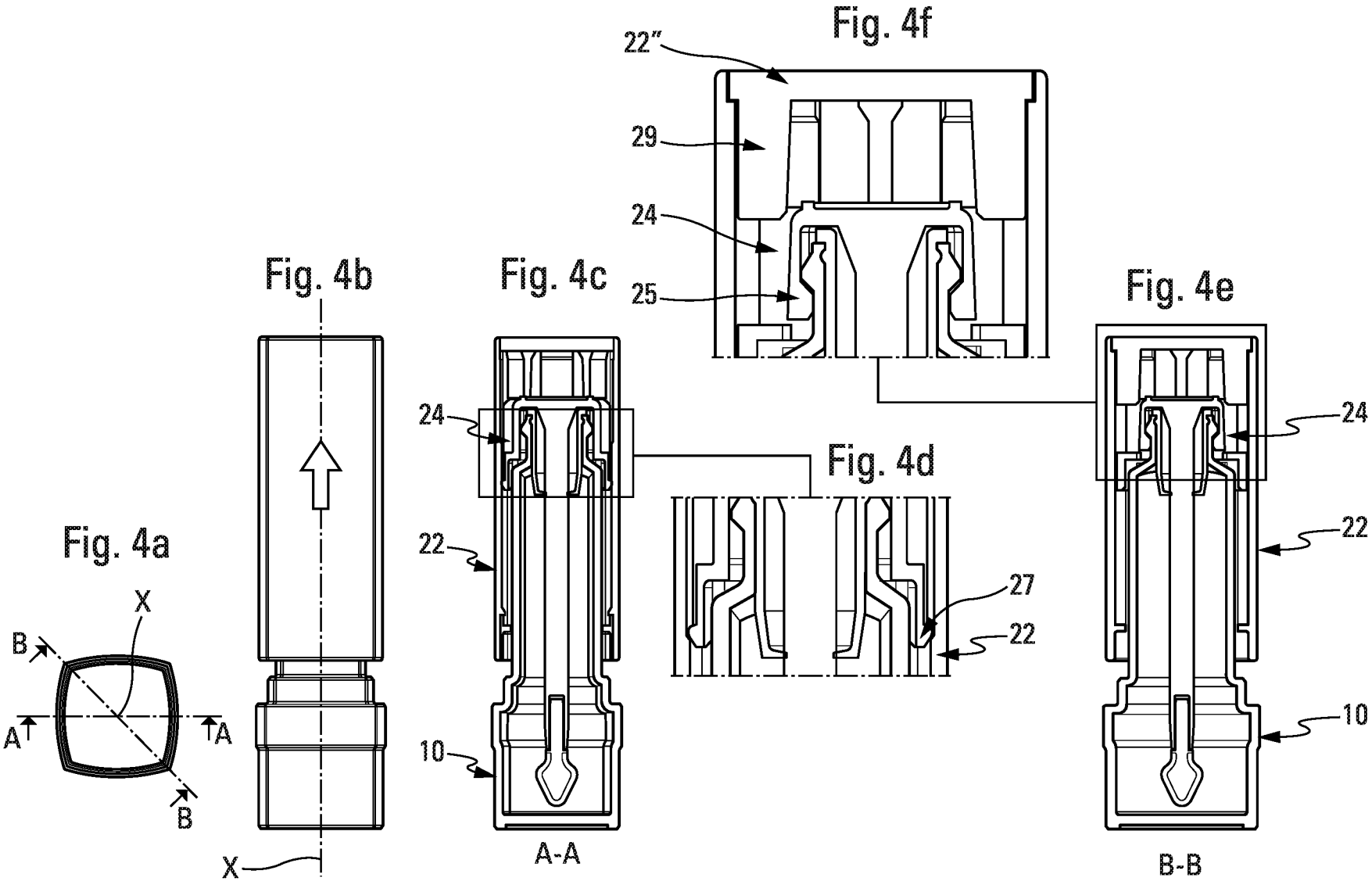
Figures 5A, 5B, 5C, 5D, 5E, 5F:
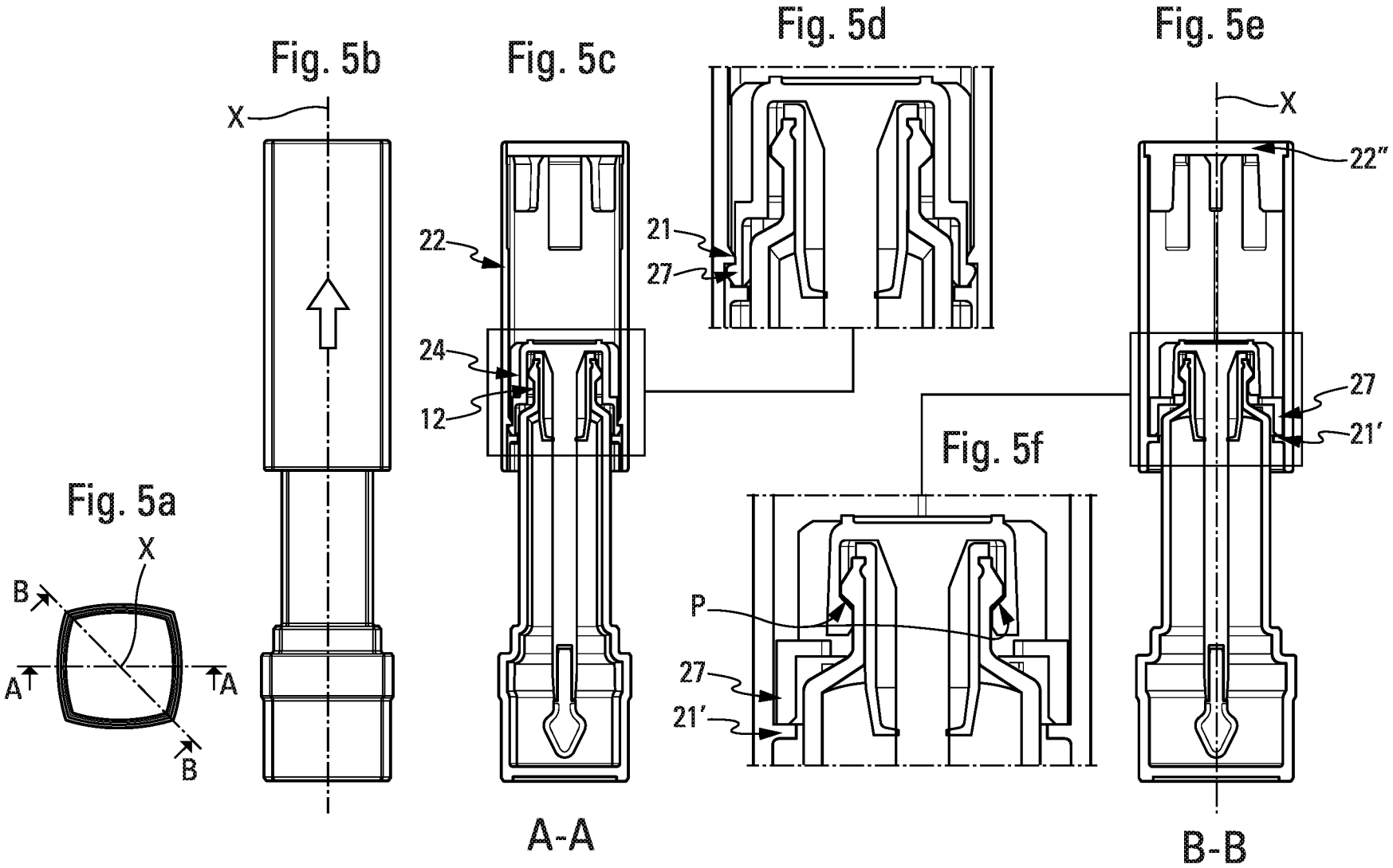
Figures 6A, 6B, 6C, 6D, 6E:
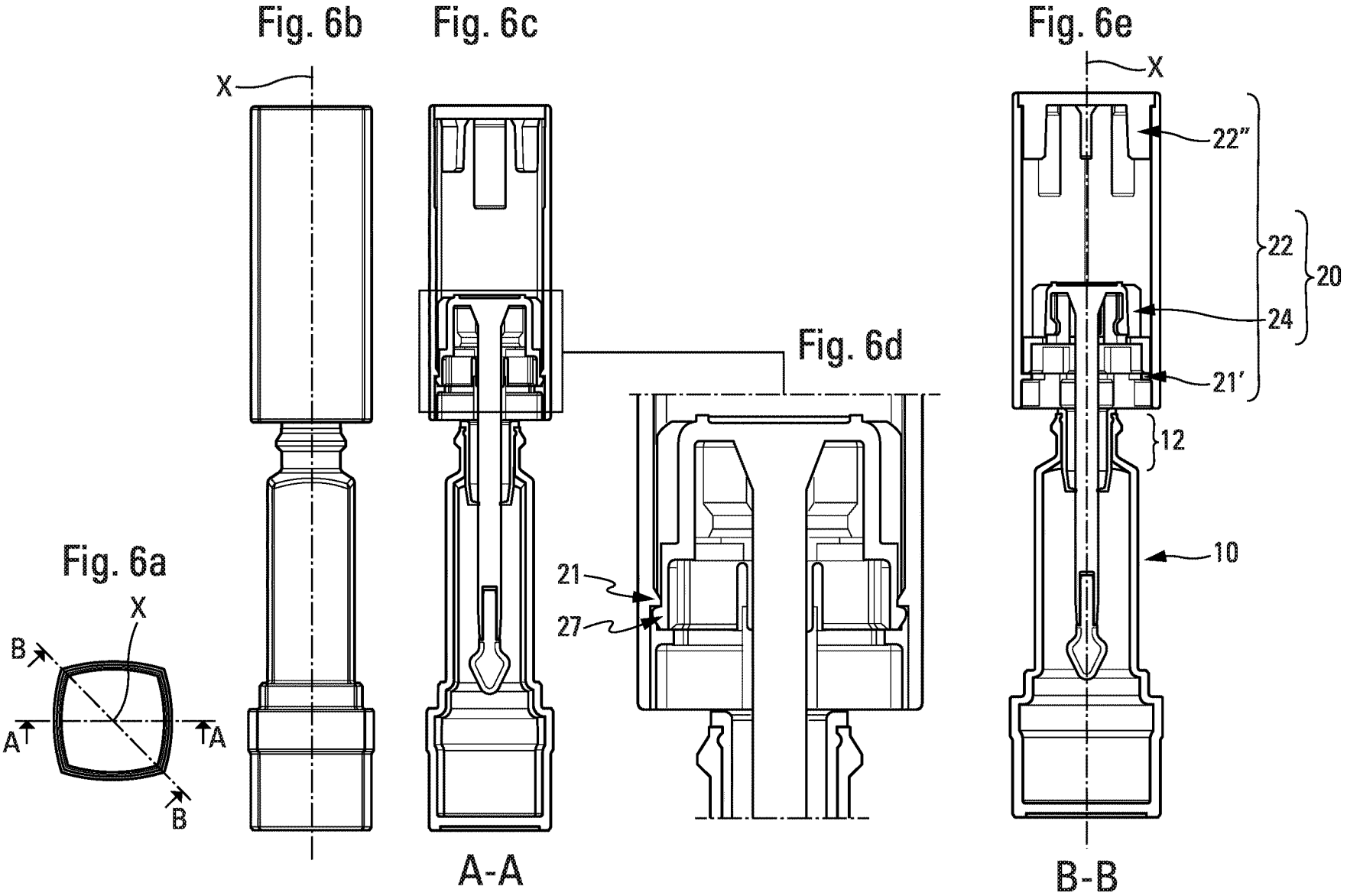

According to the invention, also, the moving from the closing/locking to the intermediate position, then from the intermediate position to the in-use position is carried out by actuating of the outer sub-assembly 22, along the main direction X, along one single direction, referred to as the pulling direction (see arrow in FIGS. 4*b* and 5*b*).

By "actuating of the outer sub-assembly 22", this means the fact that a user takes between their fingers the applicator assembly 20, via the outer sub-assembly 22, and impresses on it a pulling movement with a reasonable force. This reasonable force makes it possible to clear the claws 27 of the inner sub-assembly 24 from the engaging thereof with the slight projection of material provided on the inner wall of the outer sub-assembly 22.

In other words, the moving from the closing/locking position to the intermediate position is carried out via the pulling of the applicator assembly 20, without rotational movement with respect to the bottle 10.

Also, in other words, the head of the bottle 12 has no threading and the movement impressed by the user in order to clear the applicator assembly 20 from the bottle is not a helical movement.

In particular, advantageously, the actuating is not carried out by an intermediate part and/or an additional sub-assembly and/or a portion of the outer sub-assembly 22 which are mobile with respect to the latter.

On the other hand, the assembly device of the invention is devoid of any elastic means for returning to any position of the assembly device. Thus, the moving from one to the other of the positions of the assembly device is not accompanied, in any case, by the actuating of a the elastic means.

In other words, the assembly device according to the invention is differentiated from push/pull mechanisms in that the user impressed only a pulling/translation movement along the main direction X on the applicator assembly 20 (or at the bottom of the bottle if they are holding the fixed applicator assembly 20). This is particularly advantageous in terms of recycling, as the elastic means, often springs, are parts that can be recycled according to a route that is different from the outer 22 and inner 24 sub-assemblies, often made of plastic.

Advantageously, the user impresses a pulling/translation movement along the main direction X in one single direction to move from the closing/locking position to the in-use position; i.e. when they want to "open" the receptacle formed by the bottle and the applicator assembly. Reciprocally, the user caused a push/translation movement along the main direction X in one single direction to move from the in-use position to the closing/locking position, i.e. when they want to "close" the receptacle formed by the bottle and the applicator assembly.

Advantageously, also, the embedding of the inner sub-assembly 24 in the outer sub-assembly 22 is a telescopic embedding, along a relatively "long" course, since this course is possible over almost all of the height of the outer sub-assembly 22. By "height of the outer sub-assembly 22", this means the distance that can be measured, along the main direction X, between two blocking means 21', 22" of the outer sub-assembly 22 (see description hereinafter for the introduction of the numerical references). Thus, the rod marked as 23 in FIG. 2 can be almost fully embedded inside the outer sub-assembly 22, in particular when the device of the invention is in the closing/locking position (invisible therefore for a user if the outer sub-assembly 22 is opaque/non-transparent).

More specifically, such as shown in FIGS. 4*c* and 4*d*, the user pulls on the outer sub-assembly 22; this drives the beads of material 27 to rub against the inner wall of the outer sub-assembly 22: the outer sub-assembly 22 and the inner sub-assembly 24 then slide with respect to one another, along the main direction X.

This movement is advantageous, as the user does not perceive it.

This movement can be qualified as a telescopic movement, as the inner sub-assembly 24 is hidden from the eyes of the user by the outer sub-assembly 22 (as long as the constituent elements of the outer sub-assembly 22 are not transparent, of course). This movement is advantageous, also, as the claws 25/beads of material 27 are protected from the outside by the outer sub-assembly 22; thus, the claws 25/beads of material 27 do not injure the user, or undergo any mechanical stresses likely to damage them.

It is useful to note, that the inner sub-assembly 24 is engaged on the head 12 of the bottle 10 in the intermediate position; the inner sub-assembly 24 therefore remains, as when the assembly device is in the closing/locking position engaged on the head 12 of the bottle 10.

In other words, such as shown in FIGS. 4*e* and 4*f*, the finger 29 is carried away by the pulling movement impressed by the user without this having any impact on the inner sub-assembly 24, other than releasing the claws 25 which are then no longer blocked in the groove 15 by wedging of the finger 29 between the claw 25 and the inner wall of the outer sub-assembly 22.

FIGS. 5*a*-5*f* show a second state of the intermediate position, to the extent that FIGS. 4*a*-4*f* show a first state of this. On the other hand, these FIGS. 5*a*-5*f* show the assembly device according to the invention almost in the in-use position, with the difference that the inner sub-assembly 24 is still engaged on the head 12 of the bottle 10.

To arrive at the position which is shown in FIGS. 5*a*-5*f*, and starting from the position shown in FIGS. 4*a*-4*f*, the user continues to cause a pulling movement on the outer sub-assembly 22 until the beads of material 27 come into contact, then pass, an abutment 21 that protrudes from the inner wall of the outer sub-assembly 22 (see also herein below the description of FIGS. 6*a*-6*e*).

In this same movement, the inner sub-assembly 24 strikes an obstacle that it cannot pass this time: this is means referred to as blocking means and which is marked as 21' in FIGS. 5*f* and 5*e*. This blocking means 21' limits the course of the inner sub-assembly 24 with respect to the outer sub-assembly 22, along the main direction X; it prevents the inner sub-assembly 24 from escaping during the engaging of the outer sub-assembly 22 that surrounds it. Opposed to these blocking means 21', the locking part 22" is also a blocking means for the inner sub-assembly 24 as this locking part 22" also has a function of limiting the course of the inner sub-assembly 24 with respect to the outer sub-assembly 22, along the main direction X.

That is why, it is the, hereinabove, that the inner sub-assembly 24 is mobile in translation in the outer sub-assembly 22, along the main direction X, along a course limited by blocking means 21', 22", the blocking means 21', 22" being in embedded connection with the outer sub-assembly 22. These blocking means 21', 22" form ends of courses that the inner sub-assembly 24 cannot pass. Indeed, these ends of courses are excrescences of material which are sufficiently protruding with respect to the inner wall of the outer sub-assembly 22 to not be passed.

It is useful to note, that the blocking means 21' is provided, along the main direction X, on the outer sub-assembly 22, at a location that ensures that it will never come into contact with the bottle 10, in particular when the assembly device of the invention is in the closing/locking position. Thus, the blocking means 21' does not interfere with the bottle 10.

The user, then continuing the pulling movement thereof, this carries the outer sub-assembly 22 by the change in the blocking means 21': it is thus, that the claws 25, no longer clamped against the groove 15 of the head 12 of the bottle 10, can be cleared from the groove 15. This is advantageously facilitated by the fact that the groove 15 is drawn between two portions of the head 12 of the bottle 10, of which one is a zone in relief with a functional slope facilitating the clearing of the claws 25 outside the groove 15: see marker P in FIG. 5*f*. This marker P relates to the functional slope provided on the zone in relief of the head 12 of the bottle 10, as well as the one also provided, facing, for the cooperation of shapes mentioned hereinabove, on the claws 25.

It is useful to note, that the claws 25 and the beads of material 27 are the two faces of flexible tabs belonging to the inner sub-assembly 24. In other words, in a first embodiment, the inner sub-assembly 24 includes at least one first flexible tab carrying a claw 25 on a face of the first flexible tab and, at least one second flexible tab carrying a bead of material 27 on a face of the second flexible tab (see, in particular, FIG. 2); in other words, a claw 25 and a bead 27 on opposite faces of two different flexible tabs.

Alternatively, not shown, the inner sub-assembly 24 includes at least one flexible tab carrying a claw 25 on a face of the flexible tab and, on the other face thereof, a bead of material 27, almost facing the claw 25.

It is also useful to note, that the flexible tabs are not elastic means for returning to a position; they are locking means.

FIGS. 6*a*-6*e* show the assembly device in the in-use position. The relative movement of the inner sub-assembly 24 in the outer sub-assembly 22 is then blocked by the interference between the bead of material 27 of the inner sub-assembly 24 and the abutment 21 of the outer sub-assembly 22. More specifically, the bead 27 and abutment 21 are excrescences of material intended to maintain the assembly device in the in-use position by a friction force. The friction force is initiated at at least one of the points of contact between the bead 27 and the abutment 21.

More specifically, the maintaining in the in-use position is made possible by the frictional forces which occur on the bead 27 which is trapped between the abutment 21 and the blocking means 21', the blocking means 21' then being used as an anti-return to the intermediate position.

In other words, this frictional force is sufficient to maintain the inner sub-assembly 24 in position with respect to the outer sub-assembly 22, except in the case of an opposite force that would push the inner sub-assembly 24 to enter into the outer sub-assembly 22.

Also, in other words, the user can use the applicator tip 40 to apply make-up/do their nails, without the inner sub-assembly 24 becoming embedded inside the outer sub-assembly 22, as it is maintained in the in-use position by the change in the friction.

Of course, the friction is overcome when the user, after having applied make-up/painted their nails, decides to close it all; i.e. to move from the in-use position to the closing/locking position by passing through the intermediate position.

In other words, the user will drive a reverse path, that remains invisible for them. This reverse path consists in bringing the applicator assembly 20 on the bottle 10, such that the inner sub-assembly 24 is engaged on the head 12 of the bottle 10, the claws 25 return to the position thereof in the groove 15, before being locked by the locking finger or fingers of the locking part 22" as was described at the beginning of the present detailed description.

The assembly device according to the invention is particularly advantageous, as it proposes an alternative and sealed locking system that makes it possible for the user to obtain imperceptible effects. In other words, this device is advantageous, as it appears simple for a user although it implements an interlocking that includes a complex system of successive abutments/beads/retaining means.

The assembly device according to the invention is advantageous, also, as the seal is obtained with a gesture that is different from an opening by rotation (system with threading).

It must be noted, that alternative embodiments are of course possible. In particular, in an embodiment not shown here, the outer sub-assembly 22 includes an additional part, produced in the form of a cage which is embedded against the inner wall thereof, the cage carrying the excrescences of materials useful for the correct operation of the device of the invention.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. An assembly device between an applicator assembly and a head of a bottle, the applicator assembly comprising:

at least two sub-assemblies of parts comprising an outer sub-assembly and an inner sub-assembly, the inner sub-assembly being mobile in translation in the outer sub-assembly, along a main direction combined with the main longitudinal extension direction of the outer sub-assembly, along a course limited by blocking means embedded in connection with the outer sub-assembly;

wherein the assembly device is configured to occupy three positions:

a closing/locking position of the applicator assembly on the head of the bottle, an in-use position of the applicator assembly, wherein the applicator assembly is not in contact with the head of the bottle, and an intermediate position, wherein the inner sub-assembly is free to slide inside the outer sub-assembly, in particular between two blocking means of the outer sub-assembly;

wherein moving from the closing/locking position to the intermediate position, and then from the intermediate position to the in-use position, is carried out by actuation of the outer sub-assembly, along said main direction, according to a single pulling.

2. The assembly device according to the claim 1, wherein the moving from one to the other of the positions of the assembly device is not accompanied by the actuation of any elastic means.

3. The assembly device according to claim 1, wherein the maintaining in the closing/locking position of the applicator assembly on the head of the bottle is carried out via cooperation of shapes between a portion of the inner sub-assembly having at least one claw and a portion of the head of the bottle having at least one groove.

4. The assembly device according to claim 1, wherein maintaining in the closing/locking position of the applicator assembly on the head of the bottle is provided by a locking part which has a finger of material adapted to block the claw in the groove by wedging said finger between the claw and the inner wall of the outer sub-assembly.

5. The assembly device according to claim 4, wherein the outer sub-assembly and the locking part form one single mechanical part and are made from the same material.

6. The assembly device according to claim 1, wherein in the in-use position, the relative movement of the inner sub-assembly in the outer sub-assembly is blocked by interference of a retaining means of the inner sub-assembly by an abutment of the outer sub-assembly.

7. The assembly device according to claim 6, wherein the retaining means of the inner sub-assembly is a bead of material protruding from the inner sub-assembly while the abutment protrudes from the inner wall of the outer sub-assembly, said bead and abutment being excrescences of material intended to maintain the assembly device in the in-use position by a frictional force, said frictional force being initiated in at least one of the points of contact between said bead and said abutment.

8. The assembly device according to claim 1, further comprising a wiper adapted for mounting in the head of the bottle and an applicator of a cosmetic product adapted for mounting at the end of a rod belonging to the inner sub-assembly, said rod having a configuration such that, when the assembly device is in the closing/locking position, said applicator is plunged inside a bottle from which comes said head of the bottle.

9. The assembly device according to claim 8, wherein the seal of said assembly device with regards to the outside when the assembly device is in the closing/locking position is ensured by crushing a portion of said wiper between the head of the bottle and a hollow portion of the inner sub-assembly, in particular with a bottom of the hollow portion of the inner sub-assembly.

* * * * *